US006729470B2

(12) United States Patent
Watlington

(10) Patent No.: US 6,729,470 B2
(45) Date of Patent: May 4, 2004

(54) PLUNGER HOLDER

(76) Inventor: Elizabeth A. Watlington, 1210 Anvil Ct., University Park, IL (US) 60466

( * ) Notice: Subject to any disclaimer, the term of this patent is extended or adjusted under 35 U.S.C. 154(b) by 106 days.

(21) Appl. No.: 10/094,489

(22) Filed: Mar. 8, 2002

(65) Prior Publication Data

US 2003/0168364 A1 Sep. 11, 2003

(51) Int. Cl.[7] ..... A47K 17/00
(52) U.S. Cl. ..... 206/349; 4/255.11
(58) Field of Search ..... D6/524, 551; 4/255.01, 4/255.05, 255.11; 206/349, 361; 312/206; 220/521

(56) References Cited

U.S. PATENT DOCUMENTS 4,211,750 A * 7/1980 Gillespie ..... 422/123
5,927,492 A * 7/1999 Moore ..... 206/349
5,984,100 A * 11/1999 Ramsey et al. ..... 206/581
6,038,709 A * 3/2000 Kent ..... 4/255.05
6,050,401 A * 4/2000 Michaelson ..... 206/225
6,109,429 A * 8/2000 Cunningham et al. ..... 206/15.2
6,241,091 B1 * 6/2001 Moore et al. ..... 206/349
6,367,621 B1 * 4/2002 Johnson ..... 206/15.3

* cited by examiner

*Primary Examiner*—Jim Foster
(74) *Attorney, Agent, or Firm*—Cardinal Law Group

(57) ABSTRACT

A plunger holder for storage of a plunger for easy access. The plunger holder provides drainage to avoid mildew and a removable drip tray for easy cleaning. The plunger holder comprises an enclosure, the enclosure having a first end and a second end, the first end having a lid opening, the second end having a drip tray opening; a lid adapted to fit the lid opening; a drip tray slidably insertable in the drip tray opening; and a support mounted within the enclosure above the drip tray. In one embodiment, the plunger holder can have ventilation openings. In yet another embodiment, the plunger holder can have an air freshener holder.

6 Claims, 5 Drawing Sheets

PLUNGER HOLDER

TECHNICAL FIELD

The technical field of this invention is receptacles, particularly, receptacles for holding a plunger.

BACKGROUND OF THE INVENTION

Bathroom drains and toilets can easily become clogged, requiring a plunger to unclog them. Often, the plunger may not be nearby for convenient use. Guests or other users may be embarrassed by having to ask for a plunger or requesting someone to do the plunging for them. In addition, storing a wet plunger in a closed area out of the way may give rise to mildew and unpleasant odors. Dirt and debris may also accumulate where the plunger drains after use.

It would be desirable to have a plunger holder that would overcome the above disadvantages.

SUMMARY OF THE INVENTION

One aspect of the present invention provides a plunger holder that allows the plunger to be stored where needed for use.

Another aspect of the present invention provides a plunger holder that allows the plunger to dry after use to avoid mildew growth.

Another aspect of the present invention provides a plunger holder that helps conceal unpleasant odors.

Another aspect of the present invention provides a plunger holder that allows easy cleanup of dirt and debris.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

DESCRIPTION OF THE PREFERRED EMBODIMENT

The present invention provides a plunger holder for storage of a plunger for easy access. The plunger holder provides drainage to avoid mildew and a removable drip tray for easy cleaning. The plunger holder comprises an enclosure, the enclosure having a first end and a second end, the first end having a lid opening, the second end having a drip tray opening; a lid adapted to fit the lid opening; a drip tray slidably insertable in the drip tray opening; and a support mounted within the enclosure above the drip tray. In one embodiment, the plunger holder can have ventilation openings. In yet another embodiment, the plunger holder can have an air freshener holder.

Figure 1:
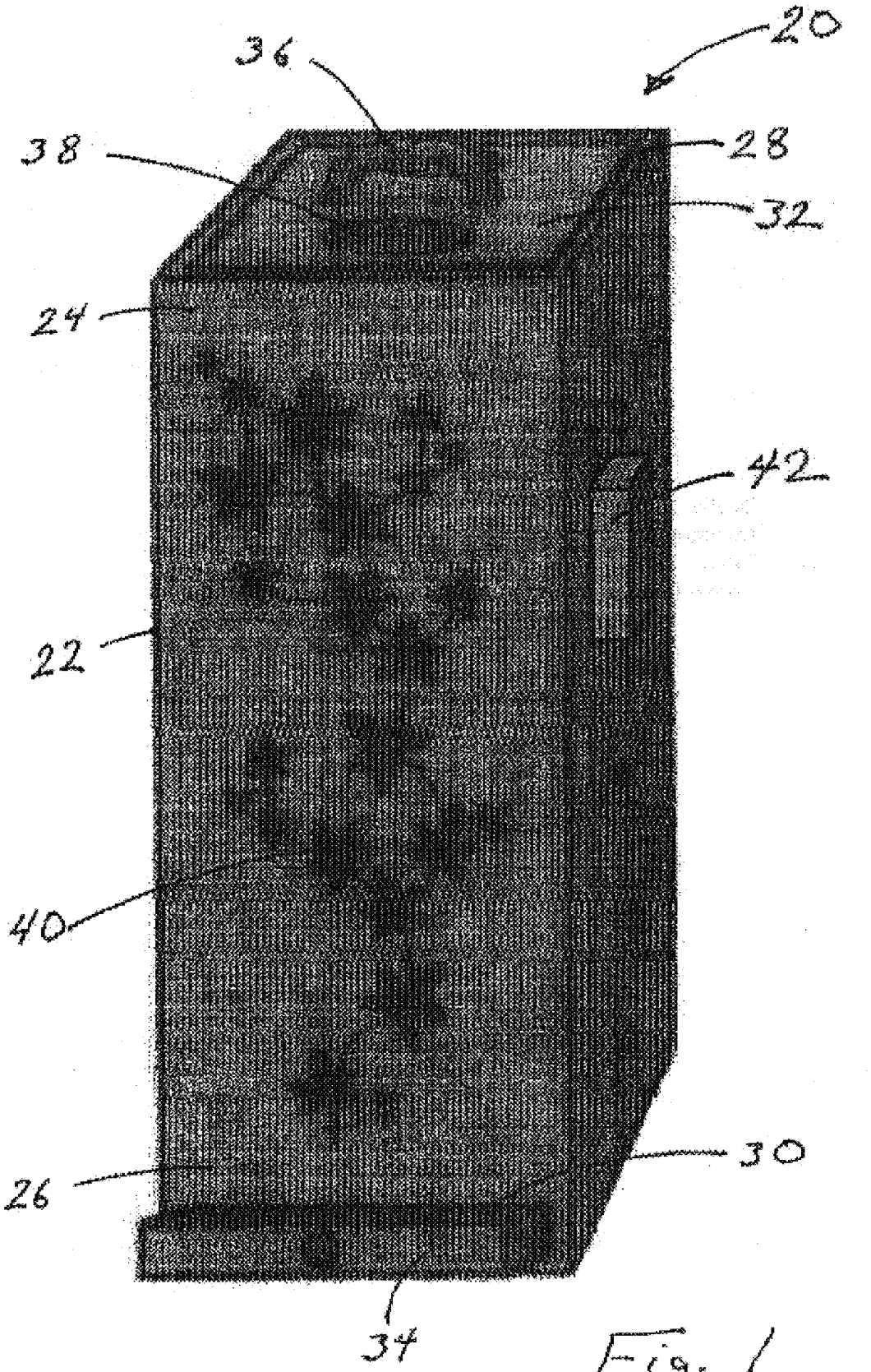
FIG. 1 shows a perspective drawing of a plunger holder made in accordance with the present invention.

FIG. 1 shows a perspective drawing of a plunger holder made in accordance with the present invention. The plunger holder 20 comprises an enclosure 22 having a first end 24 and a second end 26, with the first end 24 having a lid opening 28, the second end 26 having a drip tray opening 30. The enclosure 22 can be sized to enclose a plunger and can be made of any material suited to bathroom use. Although FIG. 1 shows an enclosure of rectangular cross section, in other embodiments the enclosure 22 can be of circular, triangular, rectangular, or other geometrically shaped cross section. The enclosure 22 can be configured to fit in a corner to minimize the floor space used.

A lid 32 adapted to fit the lid opening 28 can be installed in the lid opening 28 and a drip tray 34 slidably inserted in the drip tray opening 30. The lid 32 can further comprise a handle 36 and at least one well 38. The well 38 can be used to hold votive candles, bath beads, or other items that are aesthetically pleasing or useful in a bathroom. In another embodiment, the lid 32 can be hinged to the enclosure 22. The drip tray 34 can be removed to empty moisture or debris that may collect from the plunger. A drain plate (not shown) can support the plunger over the drip tray 34.

Ventilation openings 40 can communicate between the inside and outside of the enclosure 22 to allow the plunger to dray and avoid mold and mildew. In another embodiment, the ventilation openings can be omitted and the spacing around the lid 32 or the drip tray 34 used to provide ventilation. In yet another embodiment, the ventilation openings can be included in the lid 32. The ventilation openings 40 can be provided in decorative shapes and sizes, such as geometric shapes, leaves, butterflies, etc., to complement the décor.

An air freshener holder 42 can be mounted externally to the enclosure 22 to hold air freshener elements as are well known to those skilled in the art. In another embodiment, the air freshener holder can be mounted internal to the enclosure 22.

Figure 2:
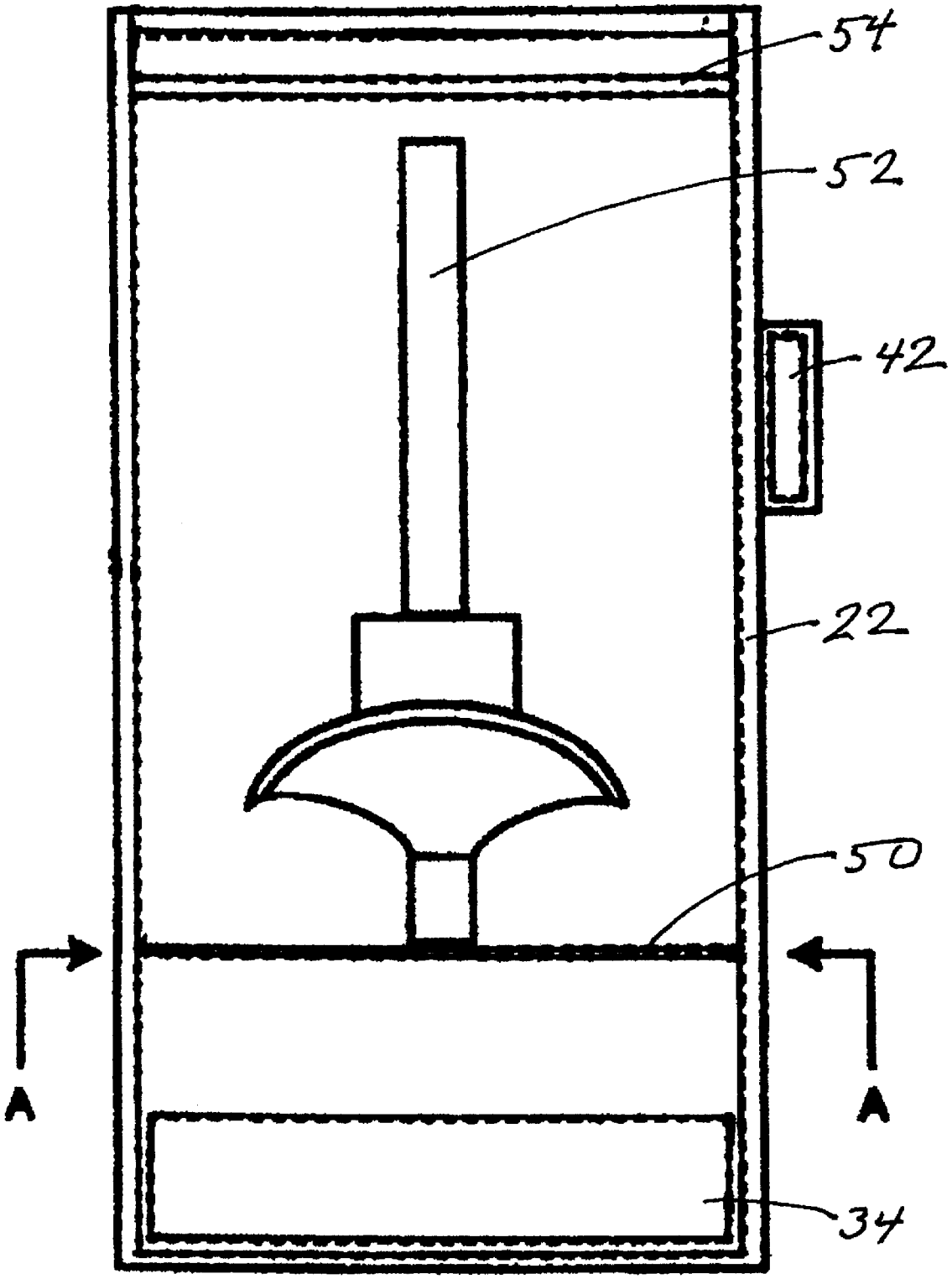
FIGS. 2 & 3 show a cross section drawing of a plunger holder made in accordance with the present invention.
Figure 3:
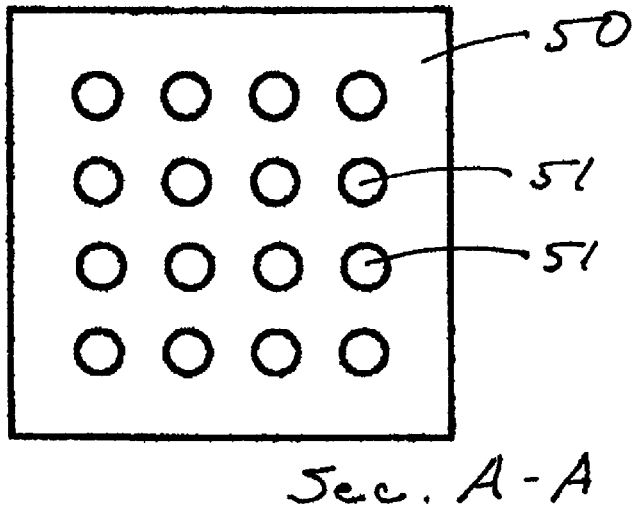

FIGS. 2 & 3, in which like elements share like reference numbers with FIG. 1, show a cross section drawing of a plunger holder made in accordance with the present invention. The enclosure 22 can provide support for a drain plate 50 through integral portions of the enclosure 22 or additional hardware fastened to the enclosure 22. The drain plate 50 can support the plunger 52 and allow any moisture from the plunger 52 to drain through the drain plate 50 into the drip tray 34. The drain plate 50 can have at least one perforation 51 for drainage. The drain plate 50 can be made of perforated sheet material or screening, and can be made of material to resist corrosion from the moisture from the plunger 52. Rails 54 can be provided around the enclosure 22 to support the lid.

Figure 4:
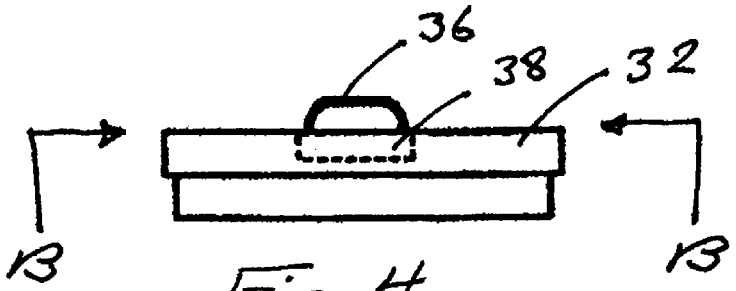
FIGS. 4 & 5 show a schematic drawing of a lid for a plunger holder made in accordance with the present invention.
Figure 5:
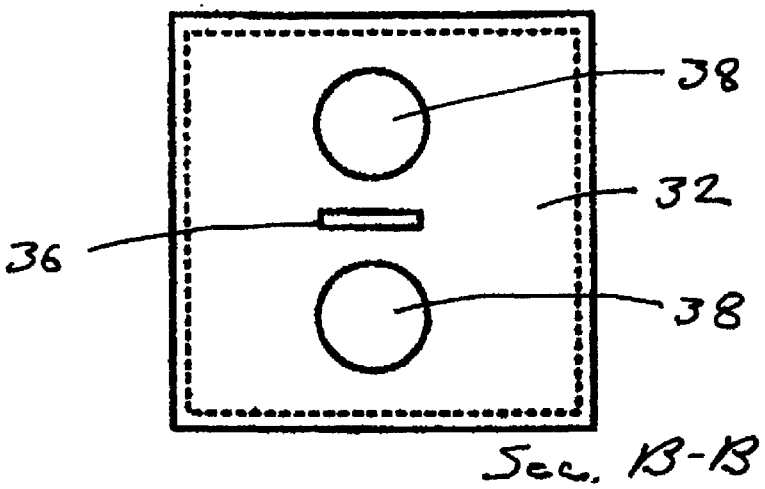

FIGS. 4 & 5, in which like elements share like reference numbers with FIG. 1, show a schematic drawing of a lid for a plunger holder made in accordance with the present invention. The lid 32 can be adapted to closing the lid opening of the plunger holder and can have a stepped configuration mateable with the rails of the enclosure (FIG. 2). The lid 32 can further comprise a handle 36 and at least one well 38. The well 38 can be used to hold votive candles, bath beads, or other items that are aesthetically pleasing or useful in a bathroom.

In use, a person opens the lid and removes the plunger from the plunger holder, then uses the plunger to remove any clog or obstruction. After use, the plunger is rinsed and re-positioned on the drain plate in the plunger holder. The lid can then be replaced. The drip tray can be removed as desired to drain accumulated moisture or for cleaning.

Figure 6:
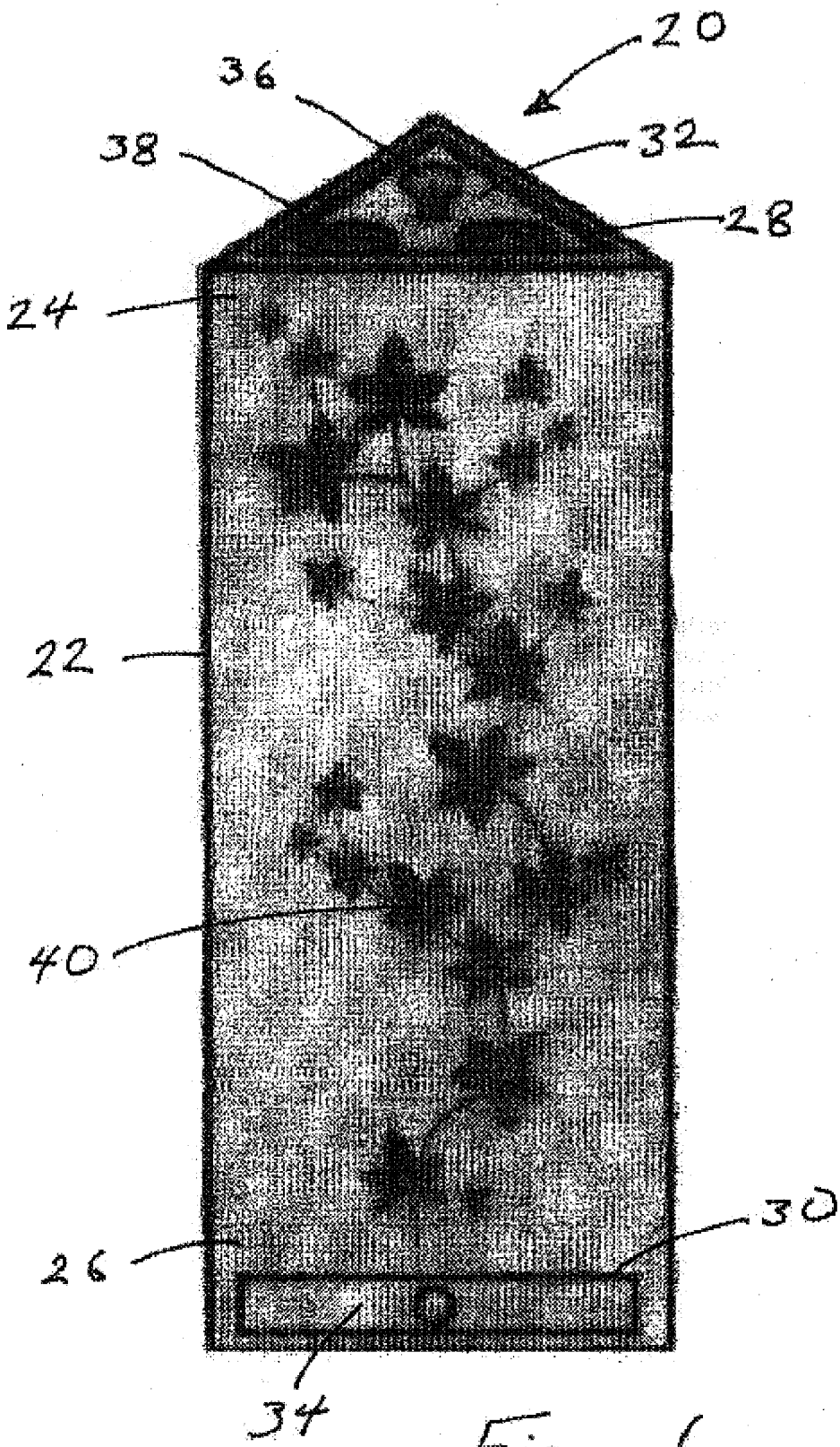
FIG. 6 shows a perspective drawing of an alternate embodiment of a plunger holder made in accordance with the present invention.
Figure 7:
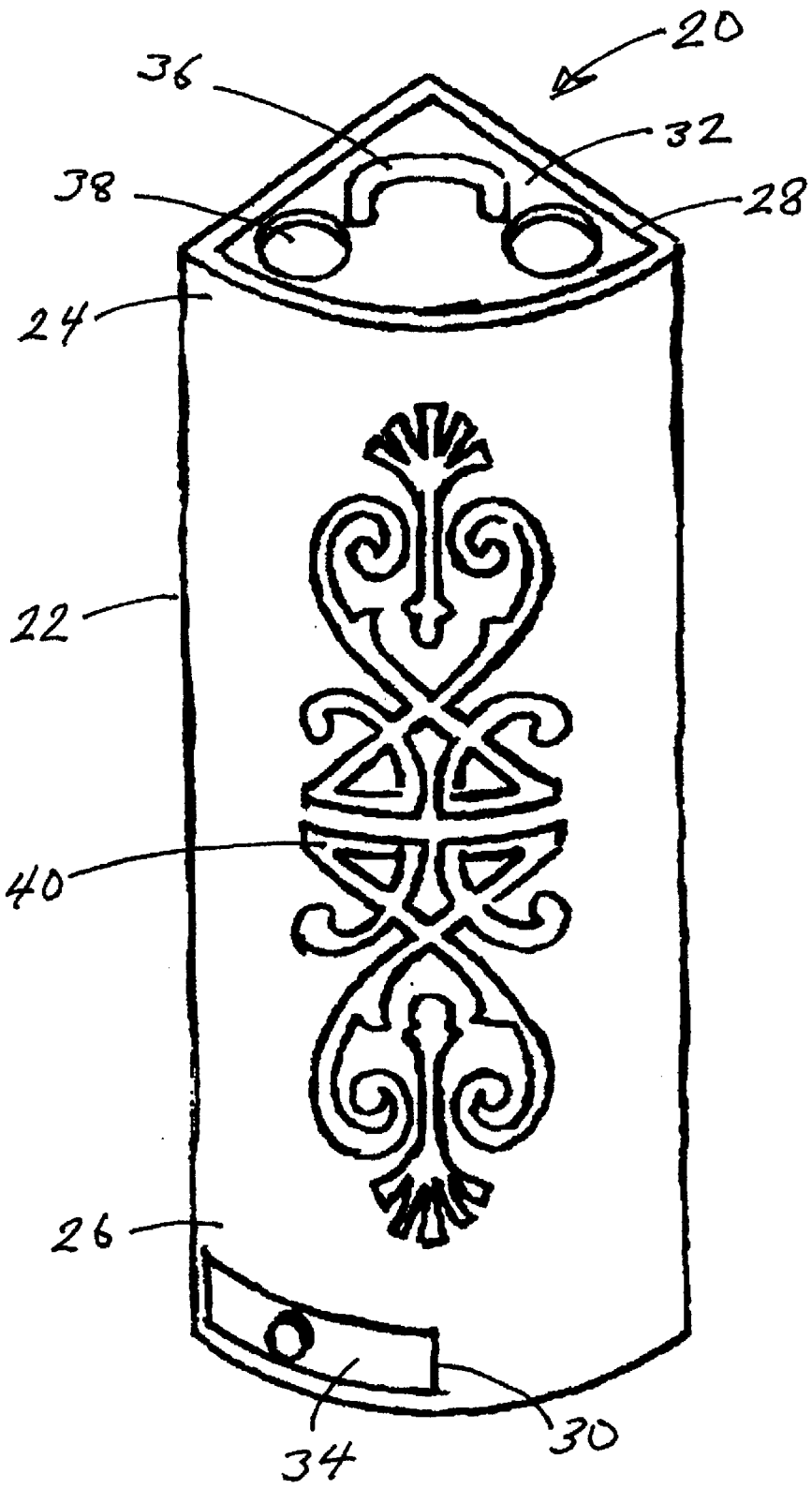
FIG. 7 shows a perspective drawing of yet another alternate embodiment of a plunger holder made in accordance with the present invention.

FIGS. 6 & 7, in which like elements share like reference numbers with FIG. 1, show perspective drawings of alternate embodiments of a plunger holder made in accordance with the present invention. In FIG. 6, the enclosure 22 of the plunger holder 20 has a triangular cross section. In FIG. 7, the enclosure 22 of the plunger holder 20 has a pie-shaped cross section, the ventilation openings 40 can be a geometric pattern.

It is important to note that FIGS. 1–7 illustrate specific applications and embodiments of the present invention, and are not intended the limit the scope of the present disclosure or claims to that which is presented therein. For example, different cross sections and enclosure profiles can be used to produce a plunger holder that is aesthetically pleasing. The various parts of the plunger holder can be connected with mechanical fasteners, integrally molded, or made with interlocking fittings to ease assembly. Upon reading the specification and reviewing the drawings hereof, it will become immediately obvious to those skilled in the art that myriad other embodiments of the present invention are possible, and that such embodiments are contemplated and fall within the scope of the presently claimed invention.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A plunger holder, comprising:

an enclosure, the enclosure having a first end and a second end, the first end having a lid opening, the second end having a drip tray opening;

a lid adapted to fit the lid opening;

a drip tray slidably insertable in the drip tray opening; and a support mounted within the enclosure above the drip tray.

2. The plunger holder of claim 1, the enclosure having ventilation openings.

3. The plunger balder of claim 1, the lid having ventilation openings.

4. The plunger holder of claim 1, the support further comprising a drain plate.

5. The plunger holder of claim 1, the lid having at least one well.

6. The plunger holder of claim 1 further comprising an air freshener holder.

* * * * *